US011120728B2

(12) United States Patent
Nagasaki et al.

(10) Patent No.: US 11,120,728 B2
(45) Date of Patent: Sep. 14, 2021

(54) DISPLAY DEVICE AND IMAGE CAPTURING DEVICE

(71) Applicant: CANON KABUSHIKI KAISHA, Tokyo (JP)

(72) Inventors: Mizuki Nagasaki, Yokohama (JP); Takahiro Yamasaki, Tachikawa (JP); Yasushi Matsuno, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/676,738

(22) Filed: Nov. 7, 2019

(65) Prior Publication Data

US 2020/0152110 A1 May 14, 2020

(30) Foreign Application Priority Data

Nov. 9, 2018 (JP) ..... JP2018-211701

(51) Int. Cl.
*G09G 3/20* (2006.01)

(52) U.S. Cl.
CPC ..... *G09G 3/2014* (2013.01); *G09G 3/2003* (2013.01); *G09G 2310/027* (2013.01); *G09G 2310/0275* (2013.01)

(58) Field of Classification Search
CPC ..... G09G 3/2014; G09G 3/2003; G09G 2310/027; G09G 2310/0275
See application file for complete search history.

(56) References Cited

U.S. PATENT DOCUMENTS

| | | | | |
|---|---|---|---|---|
| 7,961,167 | B2 | 6/2011 | Kida et al. | |
| 2006/0139286 | A1* | 6/2006 | Kida | G09G 3/3688 345/98 |
| 2008/0122810 | A1* | 5/2008 | Murase | G09G 3/3685 345/204 |
| 2019/0355311 | A1 | 11/2019 | Ota et al. | |

FOREIGN PATENT DOCUMENTS

| | | | |
|---|---|---|---|
| JP | 2005-017988 | A | 1/2005 |
| JP | 2006-171034 | A | 6/2006 |
| JP | 2011-232780 | A | 11/2011 |
| JP | 2013-288460 | A | 11/2013 |

* cited by examiner

*Primary Examiner* — Kenneth B Lee, Jr.
(74) *Attorney, Agent, or Firm* — Venable LLP

(57) ABSTRACT

A display device includes plurality of pixels arranged to form rows and columns, row selection circuit, and signal supply circuit for supplying signal to pixels of a row selected from the plurality of pixels by the row selection circuit The signal supply circuit includes first holder including first data holders, scanning circuit for sequentially selecting the first data holders and causing each selected first data holder to receive data, a second holder including blocks each including second data holders, the second holder being configured to time-divisionally receive a plurality of data held by the first holder, and DA converter for supplying a plurality of analog signals corresponding to the plurality of data held by the second holder to the pixels of the row selected from the plurality of pixels by the row selection circuit.

14 Claims, 5 Drawing Sheets

DISPLAY DEVICE AND IMAGE CAPTURING DEVICE

BACKGROUND OF THE INVENTION

Field of the Invention

The present invention relates to a display device and an image capturing device.

Description of the Related Art

Japanese Patent Laid-Open No. 2006-171034 discloses a display device that includes an effective display unit on which a plurality of pixels are arranged in a matrix, a horizontal drive circuit, and a vertical drive circuit. The vertical drive circuit includes a shift register, a sampling circuit group, and a second latch circuit group. The shift register sequentially generates a sampling pulse to select a column. The sampling circuit group sequentially samples digital image data in accordance with the sampling pulse output from the shift register. The second latch circuit group simultaneously latches the data group, which has been sampled by the sampling circuit group, to line-sequentially process the data group.

In the display device disclosed in Japanese Patent Laid-Open No. 2006-171034, the maximum transient current can increase because the second latch circuit group simultaneously latches the data group sampled by the sampling circuit group. If the maximum transient current increases, the circuits may operate erroneously because the voltage drop caused by the parasitic resistance of a power supply line cannot be ignored.

SUMMARY OF THE INVENTION

The present invention provides a technique advantageous in reducing a maximum transient current generated when data held by a first holder is received by a second holder.

One of aspects of the present invention provides a display device that includes a plurality of pixels arranged so as to form a plurality of rows and a plurality of columns, a row selection circuit configured to select a row among the plurality of rows, and a signal supply circuit configured to supply a signal to pixels of a row selected from the plurality of pixels by the row selection circuit, wherein the signal supply circuit includes a first holder including a plurality of first data holders, a scanning circuit configured to sequentially select the plurality of first data holders and cause each selected first data holder to receive data, a second holder including a plurality of blocks each including a plurality of second data holders, the second holder being configured to time-divisionally receive a plurality of data held by the first holder, and a DA converter configured to supply a plurality of analog signals corresponding to the plurality of data held by the second holder to the pixels of the row selected from the plurality of pixels by the row selection circuit.

Further features of the present invention will become apparent from the following description of exemplary embodiments with reference to the attached drawings.

DESCRIPTION OF THE EMBODIMENTS

Exemplary embodiments of the present invention will be described hereinafter with reference to the accompanying drawings.

Figure 1:
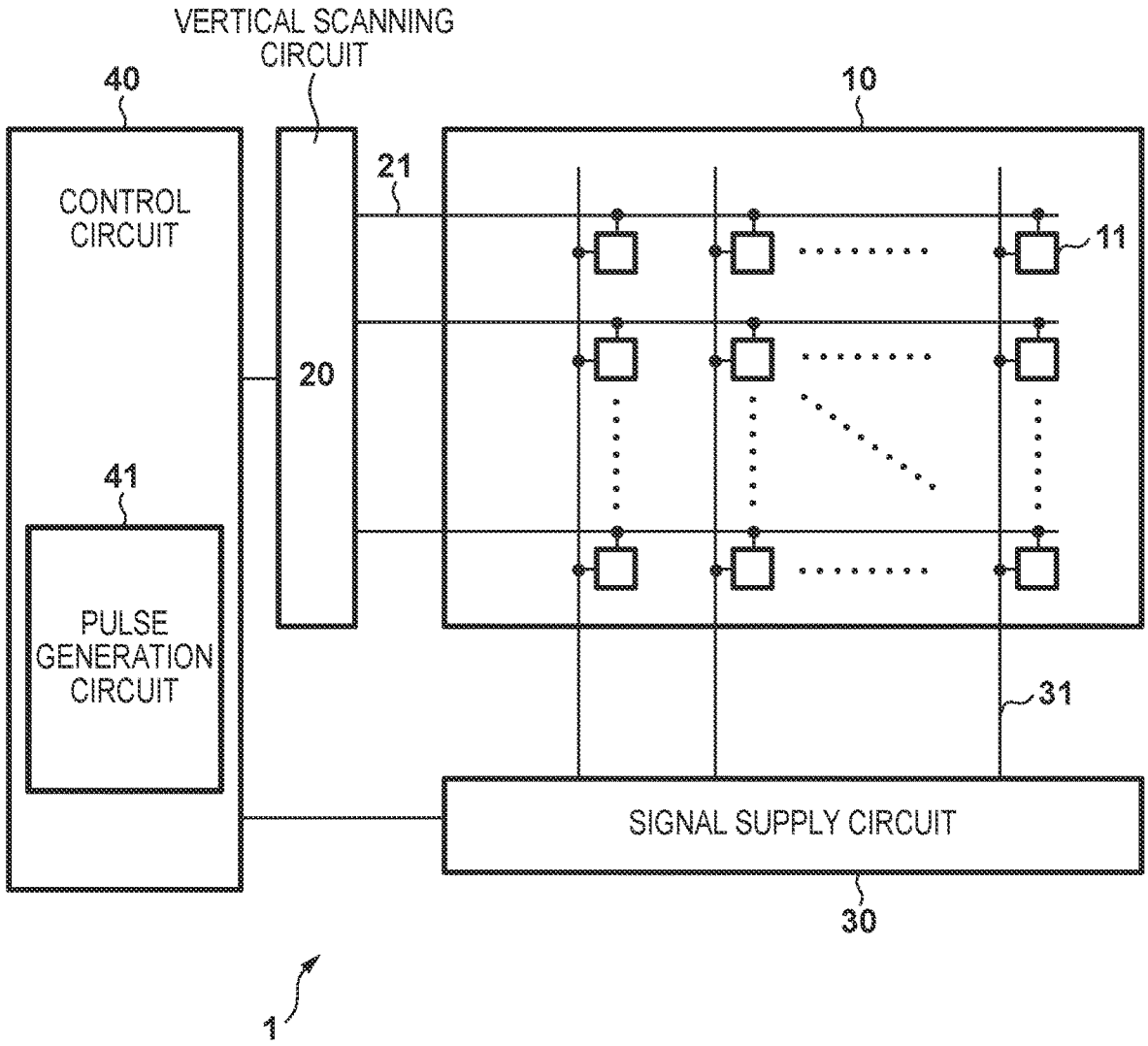
FIG. 1 is a block diagram showing the arrangement of a display device according to an embodiment of the present invention.

FIG. 1 shows the arrangement of a display device 1 according to an embodiment of the present invention. The display device 1 includes a pixel array 10, a vertical scanning circuit (row selection circuit) 20, a signal supply circuit 30, and a control circuit 40. The pixel array 10 includes a plurality of pixels 11 arranged so as to form a plurality of rows and a plurality of columns. Each pixel 11 can include a plurality of subpixels (for example, an R (red) subpixel, a G (green) subpixel, and B (blue) subpixel). The vertical scanning circuit (row selection circuit) 20 selects a row among the plurality of rows of the pixel array 10. The vertical scanning circuit 20 performs row selection by supplying a control signal to the pixels 11 of one row (the subpixels of one row) forming the row to be selected via a scanning line 21 corresponding to that row. The signal supply circuit 30 supplies, via signal lines 31, signals (luminance signals) to the pixels 11 corresponding to the one row selected by the vertical scanning circuit 20. The control circuit 40 can control the vertical scanning circuit 20 and the signal supply circuit 30.

Each signal line 31 can include a number of sub-signal lines corresponding to the plurality of subpixels (the R subpixel, the G subpixel, and the B subpixel) forming one pixel 11. Assume that the pixel array 10 is formed from six columns (the number of signal lines 31 is six) and that each signal line 31 is formed from three sub-signal lines (an R-subpixel line, a G-subpixel line, and a B-subpixel line) for the sake of descriptive convenience. However, the pixel array 10 can include more columns in practice. In addition, the number of subpixels that form one pixel 11 is not limited to three.

Figure 2:
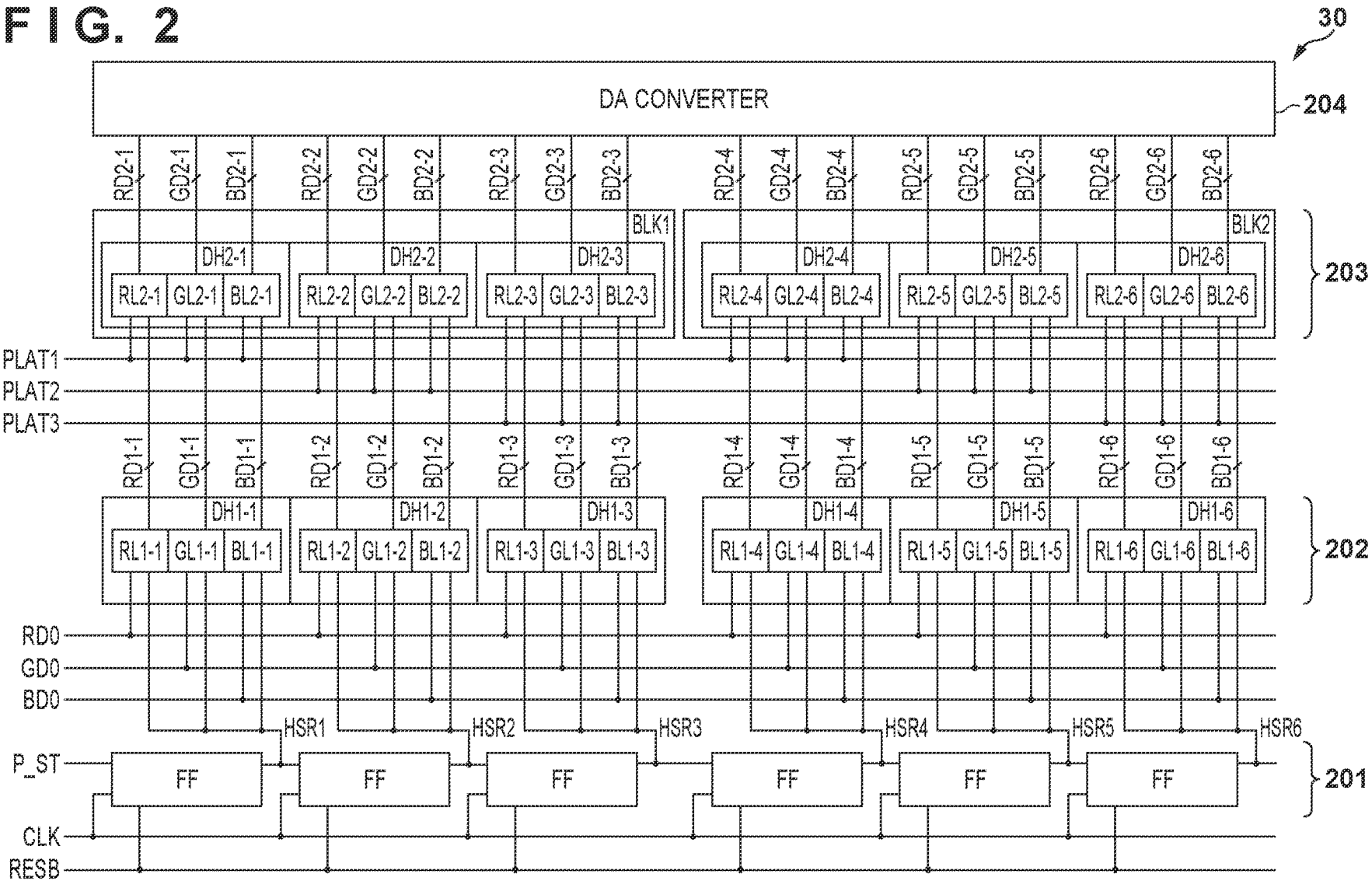
FIG. 2 is a block diagram showing an example of the arrangement of a signal supply circuit.

FIG. 2 shows an example of the signal supply circuit 30. The signal supply circuit 30 can include a scanning circuit 201 (shift register), a first holder 202, a second holder 203, and a DA converter (Digital-to-Analog converter) 204. The first holder 202 includes plurality of first data holders DH1-1, DH1-2, DH1-3, DH1-4, DH1-5, and DH1-6. Assume that an index "–x" (x=1 to 6 in this example) added to each character string (for example, DH1) corresponds to a column of the pixel array 10. For example, DH1-1 denotes a first data holder corresponding to the first column of the pixel array 10, that is, the first data holder for supplying a signal to the first column of the pixel array 10. Assume that the first data holders will be described hereinafter as the first data holders DH1 in a case in which the column need not be specified. Each first data holder DH1 can include an R-subpixel latch RL1, a G-subpixel latch GL1, and a B-subpixel latch BL1 for supplying signals to the R subpixel, G subpixel, and B subpixel, respectively.

The second holder 203 includes a plurality of blocks BLK1 and BLK2, and each block includes a plurality of second data holders DH2. For example, the first block BLK1 includes, as the plurality of second data holders DH2, second data holders DH2-1, DH2-2, and DH2-3. Also, the second block BLK2 includes, as the plurality of second data holders DH2, second data holders DH2-4, DH2-5, and DH2-6. The second holder 203 time-divisionally receives a plurality of data held by the first holder 202 and holds the received data. From another point of view, each of the plurality of blocks BLK1 and BLK2 time-divisionally receives a plurality of data held by the first holder 202 and holds the received data. Each second data holder DH2 can include an R-subpixel latch RL2, a G-subpixel latch GL2, and a B-subpixel latch BL2 for supplying signals to the R subpixel, G subpixel, and B subpixel, respectively.

A two-stage holder is formed by the first holder 202 and the second holder 203. The first holder 202 is in charge of receiving and holding luminance data (formed by R data RD0, G data GD0, and B data BD0 in this example) supplied from the control circuit 40, and the second holder 203 is in charge of supplying luminance data (formed by R data RD2, G data GD2, and B data BD2 in this example) to the DA converter 204. This kind of arrangement is advantageous in increasing the processing speed because the luminance data reception operation and the luminance data supplying operation can be performed in parallel.

The scanning circuit 201 sequentially selects the plurality of first data holders DH1 of the first holder 202 and causes the selected first data holder DH1 to receive data. The scanning circuit 201 can be formed by a shift register. The shift register can be formed by six (six stages of) flip-flops which are series-connected so as to sequentially transfer a pulse to a subsequent stage upon receiving a start pulse P_ST supplied from the control circuit 40. The shift register can be formed so that the plurality of flip-flops FF will sequentially transfer a pulse in synchronization with a clock signal CLK. Each flip-flop FF can be reset by a reset signal RESB supplied from the control circuit 40. The clock signal CLK can be generated by the control circuit 40 based on a reference clock signal generated by, for example, an external device or the display device 1. The scanning circuit 201 can output the output signals from the six flip-flops FF as write pulses HSR1 to HSR6, respectively. The DA converter 204 can supply a plurality of analog signals corresponding to the plurality of data sets held by the second holder 203 to the pixels 11 of the row selected from the plurality of pixels 11 by the vertical scanning circuit (row selection circuit) 20.

The control circuit 40 can supply, as luminance data, the R data RD0, the G data GD0, and the B data BD0 to the first holder 202 of the signal supply circuit 30. The first holder 202 receives and holds the R data RD0, the G data GD0, and the B data BD0 in accordance with the write pulses HSR1 to HSR6. In this case, in the first holder 202, a first data holder DH1-*x* receives and holds the R data RD0, the G data GD0, and the B data BD0 in accordance with a write pulse HSRx (x=1 to 6) and outputs the received and held data as R data RD1, G data GD1, and B data BD1. In the second holder 203, the second data holder DH2 receives and holds the R data RD1, the G data GD1, and the B data BD1 in accordance with a corresponding one of write pulses PLAT1 to PLAT3 and outputs the received and held data as the R data RD2, the G data GD2, and the B data BD2. The control circuit 40 can include a pulse generation circuit 41 that generates the write pulses PLAT1 to PLAT3. The pulse generation circuit 41 may be included in the signal supply circuit 30.

Figure 3:
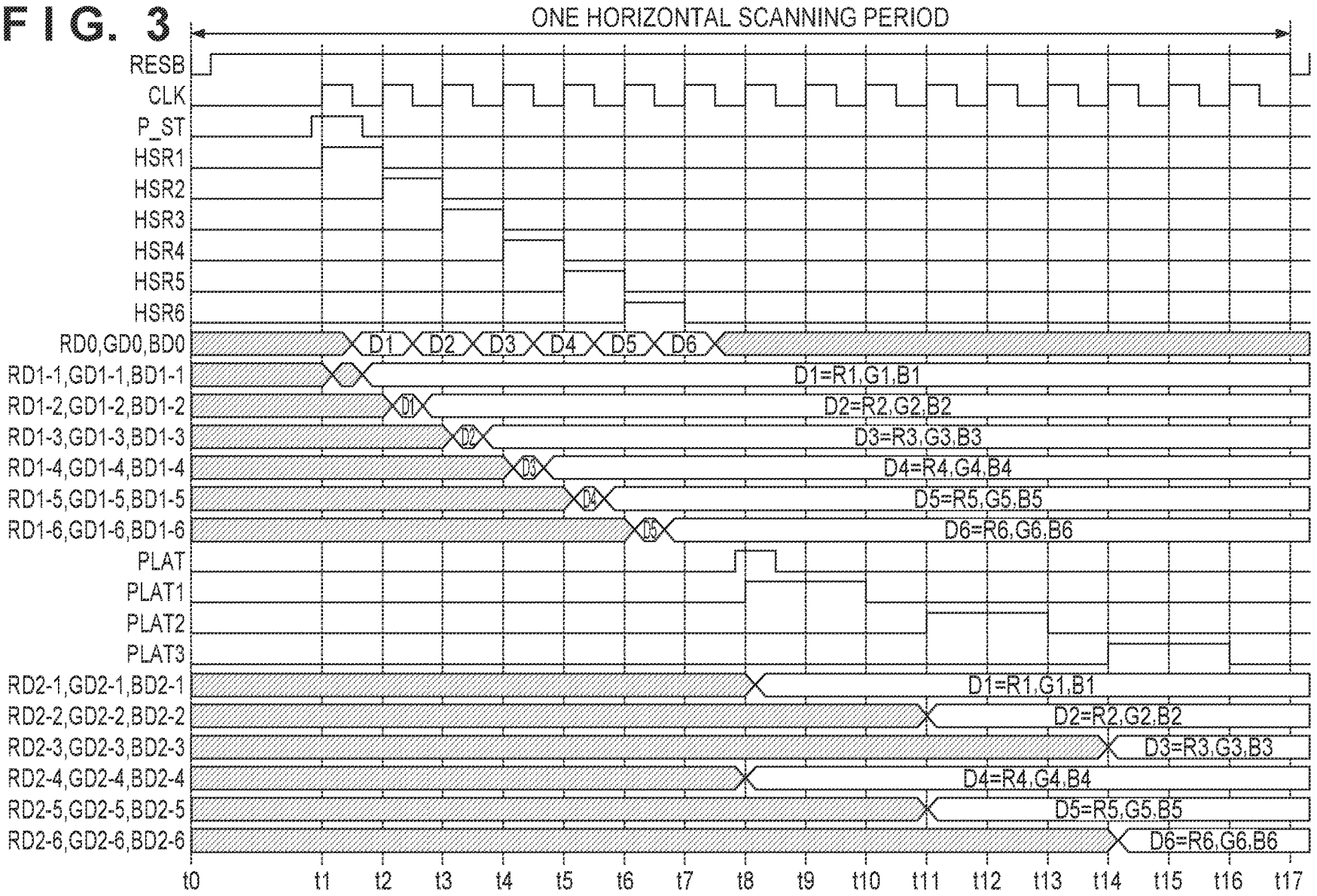
FIG. 3 is a timing chart showing an example of the operation of a signal output circuit according to the first embodiment.

FIG. 3 shows an example of the operation of a signal supply circuit 30 according to the first embodiment. At time to, a reset signal RESB shifts to the active level (low level), thereby resetting write pulses HSR1 to HSR6 which are output signals of the six-stage flip-flops FF forming the shift register of a scanning circuit 201. Subsequently, after the reset signal RESB has shifted to the inactive level (high level), the supplying of a clock signal CLK is started from time t1. A control circuit 40 supplies a start pulse P_ST, which is set to the active level during a period including time t1, to the scanning circuit 201. The scanning circuit 201 sequentially transfers the pulse signal to the subsequent stages in synchronization with the clock signal CLK to generate the write pulses HSR1 to HSR6 which do not overlap each other.

The write pulse HSR1 is set to the active level from time t1 to time t2, and R data RD0, G data GD0, and B data BD0 are received and held by a first data holder DH1-1 (RL1-1, GL1-1, and BL1-1) of a first holder 202. The write pulse HSR2 is set to the active level from time t2 to time t3, and the R data RD0, the G data GD0, and the B data BD0 are received and held by a first data holder DH1-2 (RL1-2, GL1-2, and BL1-2) of the first holder 202.

The write pulse HSR3 is set to the active level from time t3 to time t4, and the R data RD0, the G data GD0, and the B data BD0 are received and held by a first data holder DH1-3 (RL1-3, GL1-3, and BL1-3) of the first holder 202. The write pulse HSR4 is set to the active level from time t4 to time t5, and the R data RD0, the G data GD0, and the B data BD0 are received and held by a first data holder DH1-4 (RL1-4, GL1-4, and BL1-4) of the first holder 202.

The write pulse HSR5 is set to the active level from time t5 to time t6, and the R data RD0, the G data GD0, and the B data BD0 are received and held by a first data holder DH1-5 (RL1-5, GL1-5, and BL1-5) of the first holder 202. The write pulse HSR6 is set to the active level from time t6 to time t7, and the R data RD0, the G data GD0, and the B data BD0 are received and held by a first data holder DH1-6 (RL1-6, GL1-6, and BL1-6) of the first holder 202.

Subsequently, a pulse generation circuit 41 sets a write pulse PLAT1 to the active level from time t8 to time t10. Hence, from time t8 to time t10, a second data holder DH2-1 of a first block BLK1 of a second holder 203 will receive and hold corresponding R data RD1-1, G data GD1-1, and B data BD1-1. Also, from time t8 to time t10, a second data holder DH2-4 of a second block BLK2 of the second holder 203 will receive and hold corresponding R data RD1-4, G data GD1-4, and B data BD1-4. In this manner, the data reception operation by the second data holder DH2-1 of the first block BLK1 and the data reception operation by the second data holder DH2-4 of the second block BLK2 can be performed simultaneously in accordance with the write pulse PLAT1. The pulse generation circuit 41 can generate the write pulses PLAT1 in accordance with, for example, a timing signal PLAT generated in response to the write pulse HSR6. Alternatively, the pulse generation circuit 41 can generate the write pulse PLAT1, a write pulse PLAT2, and a write pulse PLAT3 in response to, for example, the write pulse HSR6.

The pulse generation circuit 41 sets the write pulse PLAT2 to the active level from time t11 to time t13. Hence, from time t11 to time t13, a second data holder DH2-2 of the first block BLK1 of the second holder 203 will receive and hold corresponding R data RD1-2, G data GD1-2, and B data BD1-2. Also, from time t11 to time t13, a second data holder DH2-5 of the second block BLK2 of the second holder 203 will receive and hold corresponding R data RD1-5, G data GD1-5, and B data BD1-5. In this manner, the data reception operation by the second data holder DH2-2 of the first block BLK1 and the data reception operation by the second data holder DH2-5 of the second block BLK2 can be performed simultaneously in accordance with the write pulse PLAT2.

The pulse generation circuit 41 sets the write pulse PLAT3 to the active level from time t14 to time t16. Hence, from time t14 to time t16, a second data holder DH2-3 of the first block BLK1 of the second holder 203 will receive and hold corresponding R data RD1-3, G data GD1-3, and B data BD1-3. Also, from time t14 to time t16, a second data holder DH2-6 of the second block BLK2 of the second holder 203 will receive and hold corresponding R data RD1-6, G data GD1-6, and B data BD1-6. In this manner, the data reception operation by the second data holder DH2-3 of the first block BLK1 and the data reception operation by the second data holder DH2-6 of the second block BLK2 can be performed simultaneously in accordance with the write pulse PLAT3.

As described above, the pulse generation circuit 41 generates the write pulses PLAT1 to PLAT3 so that the plurality of data held by the first holder 202 will be received time-divisionally by the second holder 203. In this case, in parallel to the data reception operation performed by one block of the plurality of blocks to receive corresponding data from the plurality of data held by the first holder, another block of the plurality of blocks will also perform the data reception operation to receive corresponding data from the plurality of data held by the first holder. Subsequently, a DA converter 204 supplies analog signals corresponding to R data RD2, G data GD2, and B data BD2 held by the second holder 203 to pixels 11 on the row selected from the plurality of pixels 11 by a vertical scanning circuit (row selection circuit) 20. As a result, the analog signals are written into the plurality of pixels 11 of the row selected by the vertical scanning circuit (row selection circuit) 20.

As described above, the pulse generation circuit 41 generates the plurality of write pulses PLAT1, PLAT2, and PLAT3 so the active periods of the plurality of write pulses PLAT1, PLAT2, and PLAT3 will not overlap each other. In other words, the pulse generation circuit 41 generates the plurality of write pulses PLAT1, PLAT2, and PLAT3 so the shift timings of the plurality of write pulses PLAT1, PLAT2, and PLAT3 will not occur at the same timing. This can prevent a large transient current from flowing when the plurality of write pulses PLAT1, PLAT2, and PLAT3 shift and suppress the maximum transient current that flows between the ground line and the power supply line of the signal supply circuit 30.

The number of the second data holders DH2 to be included in each of the plurality of blocks BLK1 and BLK2 is set so that the same number of second data holders DH2 will be set in each of the plurality of blocks BLK1 and BLK2. As a result, the transient current described above can be made uniform. The pulse generation circuit 41 can generate the plurality of write pulses PLAT1 to PLAT3 so that lengths of the active periods of the plurality of write pulses PLAT1 to PLAT3 will be equal to each other. The pulse generation circuit 41 can generate the plurality of write pulses PLAT1 to PLAT3 so that the active period of each of the plurality of write pulses PLAT1 to PLAT3 will be longer than the active period of each of the write pulses HSR1 to HSR6. The number of the plurality of write pulses PLAT1 to PLAT3 can be set to be equal to, for example, the number of second data holders DH2 (column count) forming each of the plurality of blocks BLK1 and BLK2.

In the embodiment described above, the second holder 203 executes the operation to receive data received by the first holder 202 after the end of the period (t0 to t7) in which the scanning circuit 201 executes the operation to cause all of the plurality of first data holders DH1 of the first holder 202 to receive data. However, the second holder 203 may execute the operation to receive data received by the first holder 202 in the period before the end of the period in which the scanning circuit 201 executes an operation to cause all of the plurality of first data holders DH1 of the first holder 202 to receive data. For example, each time a set of data to be supplied to one of the plurality of blocks BLK1 and BLK2 of the second holder 203 is received by the first holder 202, the second holder 203 can also receive the set of data. More specifically, for example, the write pulse PLAT1 can be set to the active level after time t5, and the write pulse PLAT2 can be set to the active level after time t5. However, the plurality of write pulses PLAT1, PLAT2, and PLAT3 will be generated so the active periods of the plurality of write pulses PLAT1, PLAT2, and PLAT3 will not overlap each other.

Figure 4:
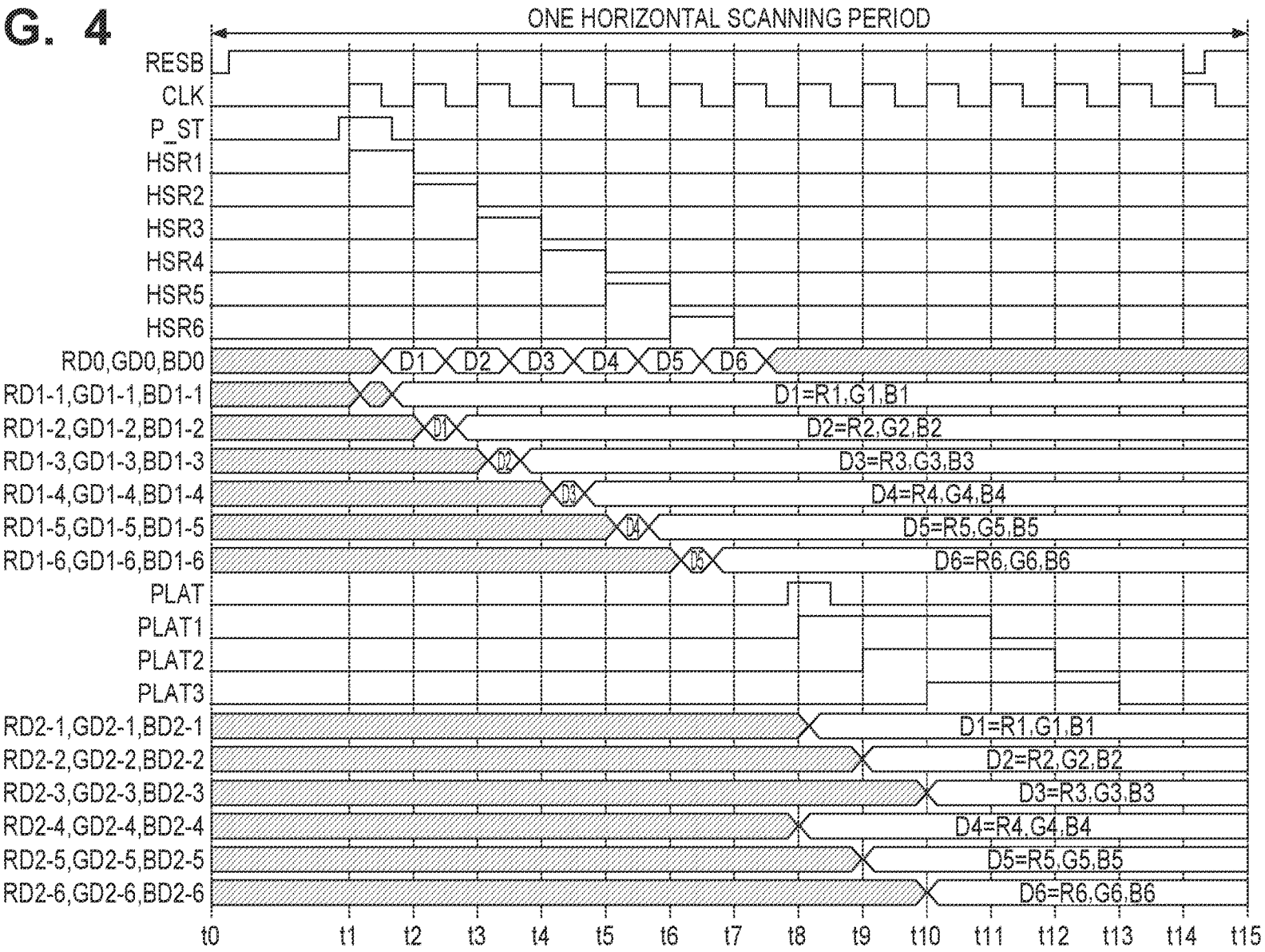
FIG. 4 is a timing chart showing an example of the operation of a signal output circuit according to the second embodiment.

FIG. 4 shows an example of the operation of a signal supply circuit 30 according to the second embodiment. In the example shown in FIG. 4, a pulse generation circuit 41 will generate a plurality of write pulses PLAT1 to PLAT3 so that the plurality of write pulses PLAT1 to PLAT3 will have active periods in which write pulses which are continuous with each other will partially overlap each other. The partial overlap between the active periods means that a part of one active period will overlap a part of another active period.

The operation performed from time t0 to time t8 in the second embodiment shown in FIG. 4 is an operation similar to the operation performed from time t0 to time t8 in the first embodiment shown in FIG. 3. The pulse generation circuit 41 sets the write pulse PLAT1 to the active level from time t8 to time t11. Hence, from time t8 to time t11, a second data holder DH2-1 of a first block BLK1 of a second holder 203 will receive and hold corresponding R data RD1-1, G data GD1-1, and B data BD1-1. Also, from time t8 to time t11, a second data holder DH2-4 of a second block BLK2 of the second holder 203 will receive and hold corresponding data R data RD1-4, G data GD1-4, and B data BD1-4. In this manner, the data reception operation by the second data holder DH2-1 of the first block BLK1 and the data reception operation by the second data holder DH2-4 of the second block BLK2 can be performed simultaneously in accordance with the write pulse PLAT1.

The pulse generation circuit 41 sets the write pulse PLAT2 to the active level from time t9 to time t11 so that a part of the active period of the write pulse PLAT2 will overlap a part of the active period of the write pulse PLAT1. Hence, from time t9 to time t11, a second data holder DH2-2 of the first block BLK1 of the second holder 203 will receive and hold corresponding R data RD1-2, G data GD1-2, and B data BD1-2. Also, from time t9 to time t11, a second data holder DH2-5 of the second block BLK2 of the second holder 203 will receive and hold corresponding R data RD1-5, G data GD1-5, and B data BD1-5. In this manner, the data reception operation by the second data holder DH2-2 of the first block BLK1 and the data reception operation by the second data holder DH2-5 of the second block BLK2 can be performed simultaneously or in parallel in accordance with the write pulse PLAT2.

The pulse generation circuit 41 sets the write pulse PLAT3 to the active level from time t10 to time t13 so that a part of the active period of the write pulse PLAT3 will overlap a part of the active period of the write pulse PLAT2. Hence, from time t10 to time t13, a second data holder DH2-3 of the first block BLK1 of the second holder 203 will receive and hold corresponding R data RD1-3, G data GD1-3, and B data BD1-3. Also, from time t10 to time t13, a second data holder DH2-6 of the second block BLK2 of the second holder 203 will receive and hold corresponding R data RD1-6, G data GD1-6, and B data BD1-6. In this manner, the data reception operation by the second data holder DH2-3 of the first block BLK1 and the data reception operation by the second data holder DH2-6 of the second block BLK2 can be performed simultaneously or in parallel in accordance with the write pulse PLAT3. The pulse generation circuit 41 may generate the write pulses PLAT1 to PLAT3 so that the active periods of three or more write pulses PLAT1 to PLAT3 will partially overlap each other.

As described above, the pulse generation circuit 41 generates the write pulses PLAT1 to PLAT3 so that the plurality of data held by a first holder 202 will be received time-divisionally by the second holder 203. In this case, in parallel to the data reception operation performed by one block of the plurality of blocks to receive corresponding data from the plurality of data held by the first holder, another block of the plurality of blocks will also perform the data reception operation to receive corresponding data from the plurality of data held by the first holder. Subsequently, a DA converter 204 supplies analog signals corresponding to R data RD2, G data GD2, and B data BD2 held by the second holder 203 to pixels 11 on the row selected from the plurality of pixels 11 by a vertical scanning circuit (row selection circuit) 20. As a result, the analog signals are written into the plurality of pixels 11 of the row selected by the vertical scanning circuit (row selection circuit) 20. The second embodiment is advantageous in shortening the length of one horizontal scanning period in addition to suppressing the maximum transient current.

The pulse generation circuit 41 can also generate the plurality of write pulses PLAT1 to PLAT3 so that lengths of the active periods of the plurality of write pulses PLAT1 to PLAT3 will be equal to each other in the second embodiment. In addition, the pulse generation circuit 41 can generate the plurality of write pulses PLAT1 to PLAT3 so that the active period of each of the plurality of write pulses PLAT1 to PLAT3 will be longer than the active period of each of the write pulses HSR1 to HSR6. Furthermore, the pulse generation circuit 41 can generate the plurality of write pulses PLAT1 to PLAT3 so that the length of a period in which each write pulse overlaps the active period of another write pulse will be equal between such periods of the plurality of write pulses PLAT1 to PLAT3.

The second holder 203 may start the operation to receive the data already received by the first holder 202 before the end of the period in which the scanning circuit 201 of the first holder 202 executes an operation to cause all of the plurality of first data holders DH1 of the first holder 202 to receive data. For example, each time a set of data to be supplied to one of the plurality of blocks BLK1 and BLK2 of the second holder 203 is received by the first holder 202, the second holder 203 can also receive the set of data. More specifically, for example, the write pulse PLAT1 can be set to the active level after time t5, and the write pulse PLAT2 can be set to the active level after time t6. However, the plurality of write pulses PLAT1, PLAT2, and PLAT3 will be generated so that the plurality of write pulses PLAT1, PLAT2, and PLAT3 will have the active periods in which write pulses which are continuous with each other will partially overlap each other.

Figure 5:
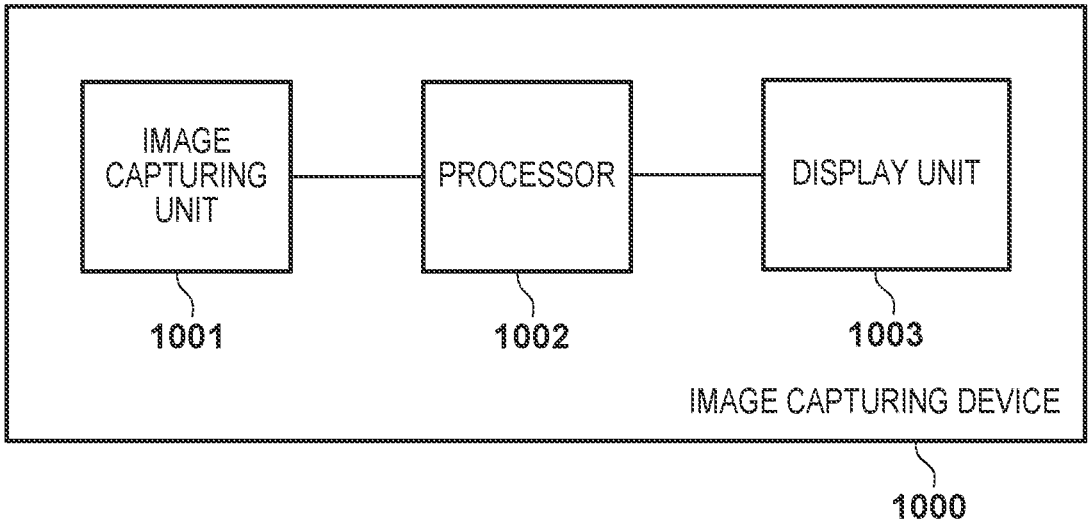
FIG. 5 is a block diagram showing an example of the arrangement of an image capturing device incorporating the display device.

FIG. 5 shows an example of the arrangement of an image capturing device 1000 which incorporates a display unit 1003 represented by the display device 1 of the embodiments described above. The image capturing device 1000 can include an image capturing unit (image sensor) 1001, a processing unit 1002 that processes an image captured by the image capturing unit 1001, and the display unit 1003 that displays the image processed by the processing unit 1002. For example, the display unit 1003 can display, other than the image captured by the image capturing unit 1001 and processed by the processing unit 1002, information for operating the image capturing device 1000. The concept of the image capturing device can include various kinds of devices that have an image capturing function. The display unit 1003 may be, for example, a back-surface display unit of an image capturing device represented by a digital still camera, a viewfinder, or a display unit arranged in another portion. The viewfinder is a display device arranged inside the finder of an image capturing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-211701, filed Nov. 9, 2018, which is hereby incorporated by reference herein in its entirety.

What is claimed is:

1. A display device comprising:

a plurality of pixels arranged so as to form a plurality of rows and a plurality of columns;

a row selection circuit configured to select a row among the plurality of rows; and a signal supply circuit configured to supply signals to pixels of a row selected from the plurality of pixels by the row selection circuit, wherein the signal supply circuit includes (1) a first holder including a plurality of first data holders, (2) a scanning circuit configured to sequentially select the plurality of first data holders and cause each selected first data holder to receive data, (3) a second holder including a plurality of blocks each including a plurality of second data holders, the second holder being configured to time-divisionally receive and hold a plurality of data for one line supplied from the first holder after the plurality of first data holders of the first holder hold the plurality of data for one line, and (4) a DA converter configured to supply a plurality of analog signals corresponding to the plurality of data supplied from the second holder to the pixels of the row selected from the plurality of pixels by the row selection circuit.

2. The device according to claim 1, wherein each of the plurality of blocks time-divisionally receives and holds corresponding data among the plurality of data supplied from the first holder.

3. The device according to claim 2, wherein in parallel to one block of the plurality of blocks receiving the corresponding data among the plurality of data supplied from the first holder, another block of the plurality of blocks receives the corresponding data among the plurality of data supplied from the first holder.

4. The device according to claim 1, wherein the number of the second data holders to be included in each of the plurality of blocks is the same for the plurality of blocks.

5. The device according to claim 1, further comprising:

a pulse generation circuit configured to generate a plurality of pulses to cause each of the plurality of blocks to receive data, wherein the pulse generation circuit generates the plurality of pulses so active periods of the plurality of pulses will not overlap each other.

6. The device according to claim 5, wherein the lengths of active periods of the plurality of pulses are equal to each other.

7. The device according to claim 1, further comprising:

a pulse generation circuit configured to generate a plurality of pulses to cause each of the plurality of blocks to receive and hold data, wherein the pulse generation circuit generates the plurality of pulses so as to include active periods in which write pulses which are continuous in the plurality of pulses will partially overlap each other.

8. The device according to claim 7, wherein the lengths of the active periods of the plurality of pulses are equal to each other.

9. The device according to claim 7, wherein the length of a period in which the active period of each pulse overlaps the active period of another pulse is equal among the plurality of pulses.

10. The device according to claim 5, wherein the active period of each of the plurality of pulses generated by the pulse generation circuit is longer than the active period of a pulse generated by the scanning circuit to cause the first holder to receive the data.

11. The device according to claim 1, wherein after the end of a period in which the scanning circuit executes an operation to cause all of the plurality of first data holders to receive data, the second holder executes an operation to receive the data received by the first holder.

12. The device according to claim 1, wherein before the end of a period in which the scanning circuit executes an operation to cause all of the plurality of first data holders to receive data, the second holder starts an operation to receive the data already received by the first holder in the period.

13. The device according to claim 12, wherein each time a set of data to be supplied to one block of the plurality of blocks of the second holder is received by the first holder, the second holder receives the set of the data.

14. An image capturing device comprising:

an image capturing unit;

a processing unit configured to process an image captured by the image capturing unit; and a display device according to claim 1, the display device being formed as a display unit configured to display the image processed by the processing unit.

* * * * *